US012687327B2

(12) United States Patent
Kabashima

(10) Patent No.: US 12,687,327 B2
(45) Date of Patent: Jul. 21, 2026

(54) REFRIGERATION APPARATUS

(71) Applicant: DAIKIN INDUSTRIES, LTD., Osaka (JP)

(72) Inventor: Nobutaka Kabashima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 130 days.

(21) Appl. No.: 18/901,301

(22) Filed: Sep. 30, 2024

(65) Prior Publication Data

US 2025/0020374 A1 Jan. 16, 2025

Related U.S. Application Data

(63) Continuation of application No. PCT/JP2023/011069, filed on Mar. 22, 2023.

(30) Foreign Application Priority Data

Mar. 31, 2022 (JP) ..... 2022-059480

(51) Int. Cl.
*F25B 31/00* (2006.01)
*F25B 43/02* (2006.01)
*F25B 49/02* (2006.01)

(52) U.S. Cl.
CPC ..... *F25B 31/004* (2013.01); *F25B 43/02* (2013.01); *F25B 49/022* (2013.01); *F25B 2700/21152* (2013.01)

(58) Field of Classification Search
CPC .... F25B 31/004; F25B 2500/16; F25B 43/02; F25B 2700/21152
See application file for complete search history.

(56) References Cited

U.S. PATENT DOCUMENTS

2020/0240415 A1* 7/2020 Kotani ..... F04B 49/20
2021/0372680 A1* 12/2021 Imanishi ..... F25B 1/04

FOREIGN PATENT DOCUMENTS

JP 2765378 B2 * 6/1998
JP 2011-153784 A 8/2011

OTHER PUBLICATIONS

English Translation of International Preliminary Report On Patentability (Chapter I) mailed on Oct. 10, 2024, in corresponding PCT/JP2023/011069, 6 pages.
Extended European search report issued on Apr. 22, 2025, in corresponding European patent Application No. 23779888.9, 6 pages.
International Search Report and Written Opinion mailed on May 23, 2023, received for PCT Application PCT/JP2023/011069, filed on Mar. 22, 2023, 9 pages including English Translation.

* cited by examiner

*Primary Examiner* — Lionel Nouketcha
(74) *Attorney, Agent, or Firm* — XSENSUS LLP

(57) ABSTRACT

A compressor unit of a refrigerant circuit includes a compressor, an oil separator, an oil return pipe, an oil return valve, and a discharge temperature sensor. A refrigeration apparatus includes a controller. The controller performs a detection operation. The detection operation is an operation of decreasing the opening degree of the oil return valve and detecting whether or not gas refrigerant is flowing through the oil return pipe based on a change in the measured value by the discharge temperature sensor after the decreasing of the opening degree of the oil return valve as compared to the measured value by the discharge temperature sensor before the decreasing of the opening degree of the oil return valve.

11 Claims, 9 Drawing Sheets

REFRIGERATION APPARATUS

CROSS-REFERENCE TO RELATED APPLICATIONS

The present application is a continuation of PCT Application No. PCT/JP2023/011069, filed on Mar. 22, 2023, which claims priority from Japanese Patent Application No. 2022-059480 filed on Mar. 31, 2022, with the Japan Patent Office, and the entire disclosures of these applications are incorporated herein by reference.

TECHNICAL FIELD

The present disclosure relates to a refrigeration apparatus.

BACKGROUND ART

Patent Document 1 discloses a refrigeration apparatus that performs a refrigeration cycle. In a refrigerant circuit of this refrigeration apparatus, an oil separator is provided on the discharge side of a compressor. A discharge pipe of the compressor is provided with a first temperature sensor. A connection pipe connecting the oil separator and a suction pipe of the compressor to each other is provided with a capillary tube and a second temperature sensor. The second temperature sensor is disposed downstream of the capillary tube in the connection pipe. The refrigeration apparatus of Patent Document 1 determines that mainly gas refrigerant is flowing through the connection pipe when a value obtained by subtracting the measured value by the second temperature sensor from the measured value by the first temperature sensor exceeds a predetermined reference value.

CITATION LIST

Patent Document

Patent Document 1: Japanese Unexamined Patent Publication No. 2011-153784

SUMMARY

A first aspect of the present disclosure is directed to a refrigeration apparatus (10) including a refrigerant circuit (15) having a compressor unit (20) and configured to perform a refrigeration cycle, and the compressor unit (20) has a compressor (30) with a compression mechanism (32) configured to compress and discharge a refrigerant, an oil separator (40) configured to separate refrigerating machine oil from a gas refrigerant discharged from the compressor (30), an oil return pipe (45) connecting the oil separator (40) to a suction pipe (35) of the compressor (30), an oil return valve (46) provided for the oil return pipe (45), and a discharge temperature sensor (50) configured to measure the temperature of the gas refrigerant discharged from the compression mechanism (32). The refrigeration apparatus (10) includes a controller (60) configured to perform a detection operation of detecting whether or not the gas refrigerant is flowing through the oil return pipe (45) based on a change in the measured value by the discharge temperature sensor (50) after decreasing of the opening degree of the oil return valve (46) as compared to the measured value by the discharge temperature sensor (50) before decreasing of the opening degree of the oil return valve (46).

DESCRIPTION OF EMBODIMENTS

First Embodiment

A first embodiment will be described. The first embodiment is an air conditioner (10). The air conditioner (10) is a refrigeration apparatus that performs a refrigeration cycle.

—Configuration of Air Conditioner—

Figure 1:
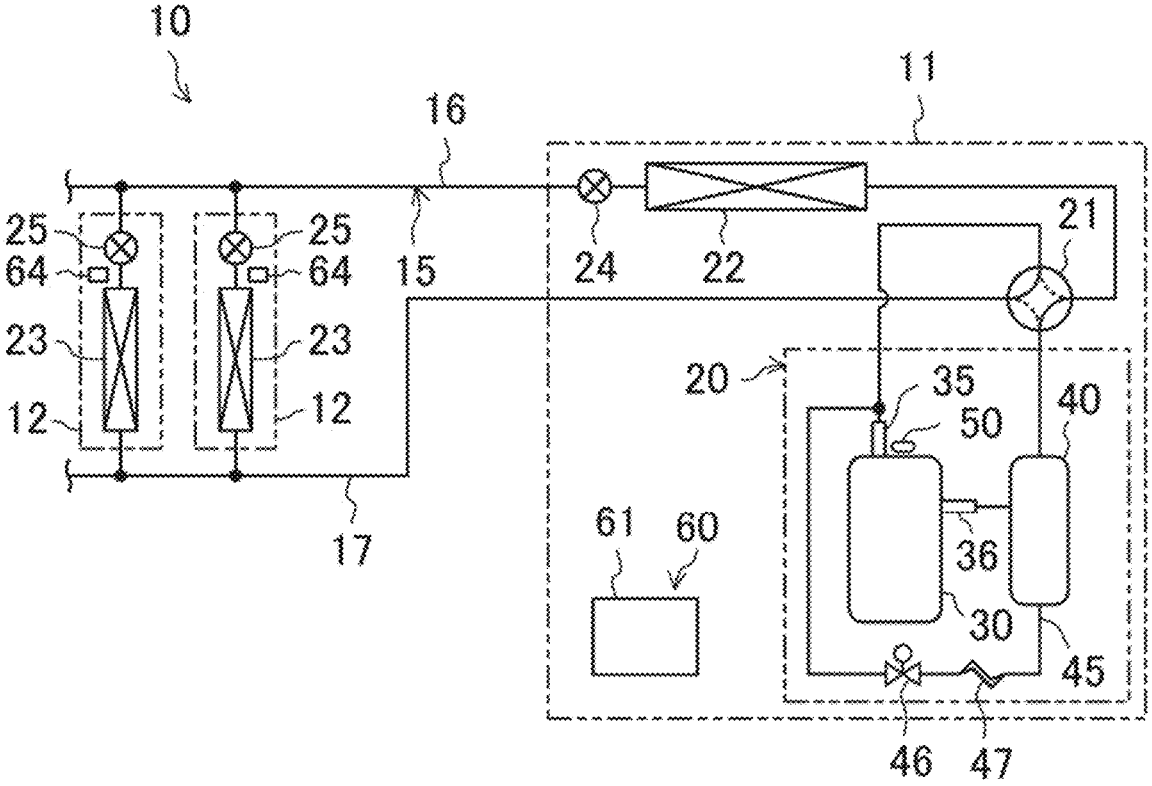
FIG. 1 is a refrigerant circuit diagram illustrating the configuration of an air conditioner according to a first embodiment.

As illustrated in FIG. 1, the air conditioner (10) includes a single outdoor unit (11) and a plurality of indoor units (12). The air conditioner (10) includes a refrigerant circuit (15). The refrigerant circuit (15) is formed by connecting each of the indoor units (12) to the outdoor unit (11) through pipes. In the refrigerant circuit (15), the indoor units (12) is connected in parallel to each other. The air conditioner (10) further includes a controller (60).

<Outdoor Unit>

The outdoor unit (11) includes a compressor unit (20), a four-way switching valve (21), an outdoor heat exchanger (22), and an outdoor expansion valve (24). The compressor unit (20) includes a compressor (30) and an oil separator (40). Although not illustrated, the outdoor unit (11) includes an outdoor fan.

In the refrigerant circuit (15), a first port of the four-way switching valve (21) is connected to the oil separator (40), and a second port of the four-way switching valve (21) is connected to the compressor (30). Moreover, in the refrigerant circuit (15), a third port of the four-way switching valve (21) is connected to the gas-side end of the outdoor heat exchanger (22), and a fourth port of the four-way switching valve (21) is connected to the gas-side end of each of the indoor units (12) through a gas-side connection pipe (17). Further, in the refrigerant circuit (15), the liquid-side end of the outdoor heat exchanger (22) is connected to one end of the outdoor expansion valve (24), and the other end of the outdoor expansion valve (24) is connected to the liquid-side end of each of the indoor units (12) through a liquid-side connection pipe (16).

The four-way switching valve (21) is a switching valve including four ports. The four-way switching valve (21) switches between a first state in which the first port communicates with the third port and the second port communicates with the fourth port (indicated by solid lines in FIG. 1) and a second state in which the first port communicates with the fourth port and the second port communicates with the third port (indicated by broken lines in FIG. 1). The outdoor heat exchanger (22) is a heat exchanger that allows heat exchange between refrigerant and outdoor air. The outdoor expansion valve (24) is an electric expansion valve.

<Compressor Unit>

As described above, the compressor unit (20) includes the compressor (30) and the oil separator (40). The compressor unit (20) further includes an oil return pipe (45), an oil return valve (46), a capillary tube (47), and a discharge temperature sensor (50).

<Compressor>

The compressor (30) is a hermetic scroll compressor. The type of compressor (30) is not limited to the scroll type.

Figure 2:
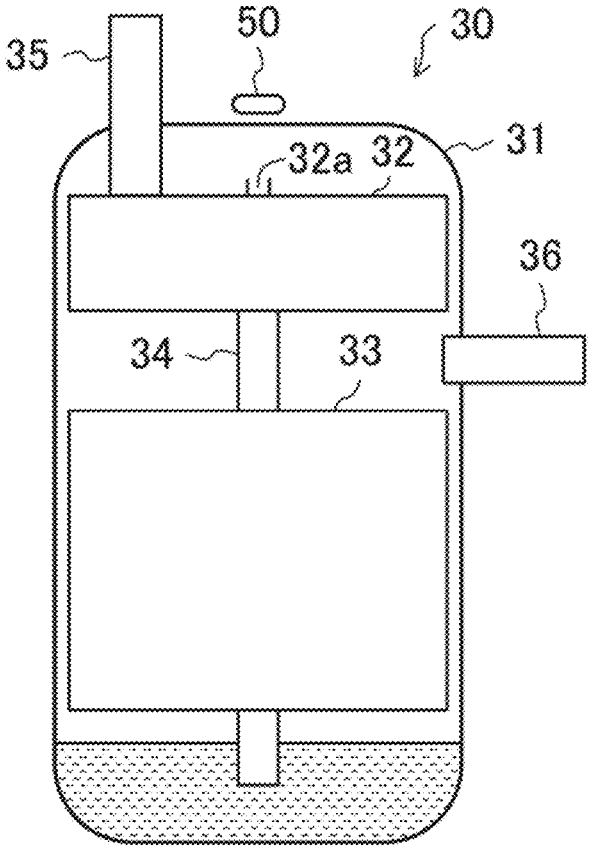
FIG. 2 is a schematic view of the configuration of a compressor included in the air conditioner of the first embodiment.

As illustrated in FIG. 2, the compressor (30) includes a casing (31), a compression mechanism (32), an electric motor (33), and a drive shaft (34). The casing (31) is a standing cylindrical member. The compression mechanism (32) is a scroll fluid machine that sucks and compresses the refrigerant. The compression mechanism (32) discharges the compressed refrigerant to the internal space of the casing (31) through a discharge port (32*a*). The electric motor (33) is coupled to the compression mechanism (32) through the drive shaft (34) to drive the compression mechanism (32). The casing (31) is provided with a suction pipe (35) and a discharge pipe (36). Through the suction pipe (35), the low-pressure refrigerant is introduced into the compression mechanism (32). Through the discharge pipe (36), the high-pressure refrigerant discharged from the compression mechanism (32) is discharged to the outside of the casing (31).

Refrigerating machine oil is stored on the bottom in the casing (31) of the compressor (30). This refrigerating machine oil is supplied to the compression mechanism (32) through an oil passage (not illustrated) formed in the drive shaft (34), and lubricates the compression mechanism (32). Part of the refrigerating machine oil supplied to the compression mechanism (32) is discharged from the compression mechanism (32) together with the compressed refrigerant. Thus, the gas refrigerant flowing out of the casing (31) through the discharge pipe (36) contains the refrigerating machine oil in the form of mist.

The refrigerant compressed in the compression mechanism (32) is discharged into the internal space of the casing (31) through the discharge port (32*a*). The refrigerant discharged from the compression mechanism (32) into the internal space of the casing (31) is guided downward of the electric motor (33), then flows upward, and flows out of the casing (31) through the discharge pipe (36).

<Oil Separator>

The oil separator (40) is a member for separating the refrigerating machine oil from the gas refrigerant discharged from the compressor (30). The oil separator (40) is formed in a standing cylindrical shape. The discharge pipe (36) of the compressor (30) is connected to the side of the oil separator (40). The first port of the four-way switching valve (21) is connected to the top of the oil separator (40). One end of the oil return pipe (45) is connected to the bottom of the oil separator (40). In the oil separator (40), the refrigerating machine oil is separated from the gas refrigerant having flowed in from the compressor (30). The refrigerating machine oil separated from the gas refrigerant falls by the force of gravity, and stays on the bottom in the oil separator (40).

<Oil Return Pipe>

The oil return pipe (45) is a pipe connecting the oil separator (40) and the suction pipe (35) of the compressor (30) to each other. One end of the oil return pipe (45) is connected to the bottom of the oil separator (40), and communicates with the internal space of the oil separator (40). The other end of the oil return pipe (45) is connected to the suction pipe (35) of the compressor (30).

The oil return pipe (45) is provided with the capillary tube (47) and the oil return valve (46). The capillary tube (47) and the oil return valve (46) are arranged in this order from one end to the other end of the oil return pipe (45). The oil return valve (46) is an electromagnetic valve switchable between an open state and a closed state.

<Discharge Temperature Sensor>

The discharge temperature sensor (50) is a sensor for measuring the temperature of the refrigerant discharged from the compression mechanism (32) of the compressor (30). The discharge temperature sensor (50) is attached to the outer surface of the casing (31) of the compressor (30). The discharge temperature sensor (50) is attached to a portion of the top of the casing (31) facing the discharge port (32*a*) of the compression mechanism (32) (see FIG. 2). The measured value by the discharge temperature sensor (50) is substantially the temperature of the refrigerant discharged from the compression mechanism (32) before passing by the electric motor (33).

The discharge temperature sensor (50) may be disposed in the internal space of the casing (31). In this case, the discharge temperature sensor (50) directly contacts the refrigerant discharged from the compression mechanism (32), and measures the temperature of the refrigerant.

<Indoor Unit>

Each of the indoor units (12) includes an indoor heat exchanger (23) and an indoor expansion valve (25). The indoor heat exchanger (23) and the indoor expansion valve (25) are arranged in this order from the gas-side end to the liquid-side end of the indoor unit (12). Although not illustrated, each indoor unit (12) includes an indoor fan.

The indoor heat exchanger (23) is a heat exchanger that allows heat exchange between the refrigerant and indoor air. The indoor expansion valve (25) is an electric expansion valve.

<Controller>

The controller (60) includes a single outdoor controller (61) and a plurality of indoor controllers (64). The outdoor controller (61) is provided for the outdoor unit (11). One indoor controller (64) is provided for each indoor unit (12). The outdoor controller (61) and each indoor controller (64) communicate with each other via wires.

Figure 3:
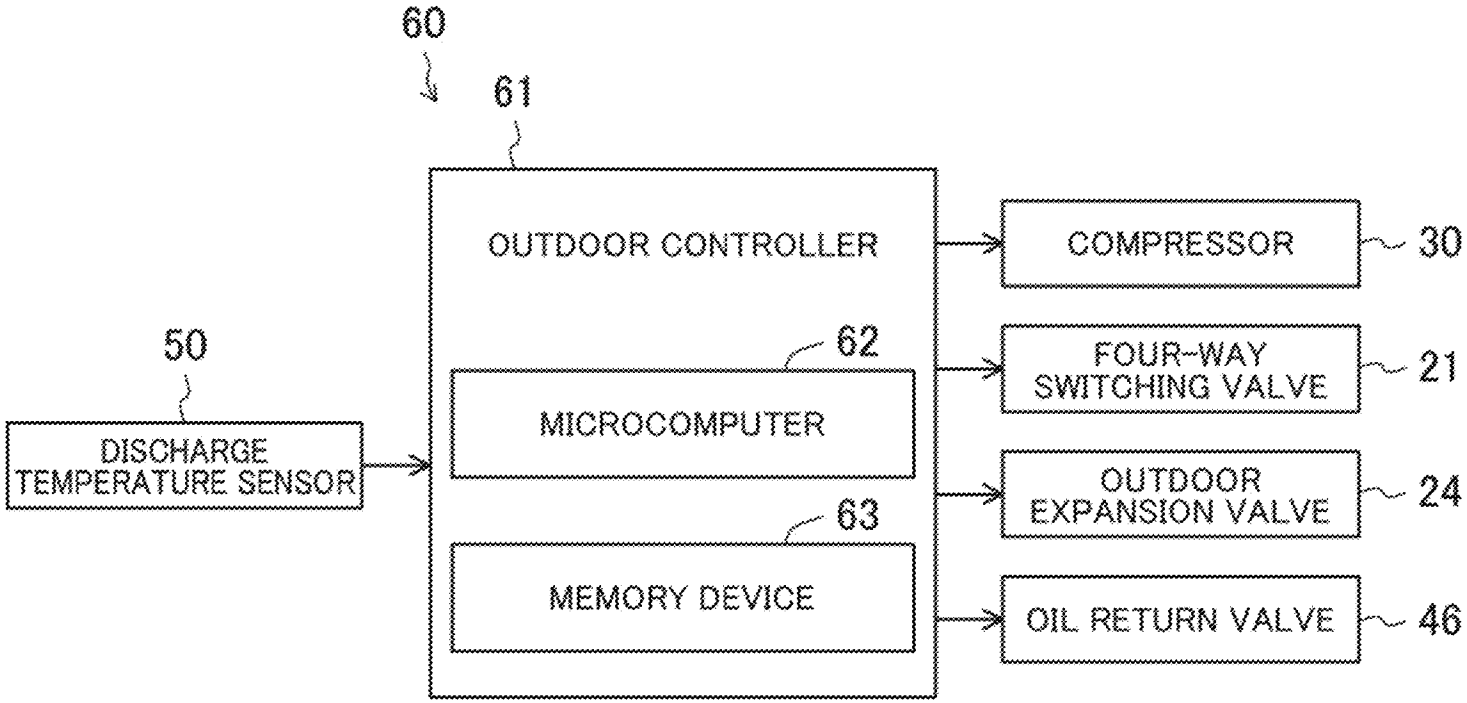
FIG. 3 is a block diagram illustrating the configuration of a controller included in the air conditioner of the first embodiment.

As illustrated in FIG. 3, the outdoor controller (61) includes a microcomputer (62) mounted on a control board, and a memory device (63) storing software for operating the microcomputer (62). The memory device (63) is a semiconductor memory. The outdoor controller (61) receives measured values from various sensors provided for the outdoor unit (11). The outdoor controller (61) controls components provided for the outdoor unit (11). In particular, the outdoor controller (61) of this embodiment controls the oil return valve (46) based on the measured value by the discharge temperature sensor (50).

Although not illustrated, the indoor controller (64) includes a microcomputer and a memory device, as in the outdoor controller (61). The indoor controller (64) receives measured values from various sensors provided for the indoor unit (12). The indoor controller (64) controls components provided for the indoor unit (12).

—Operation of Air Conditioner—

The air conditioner performs a cooling operation and a heating operation.

In the cooling operation, the four-way switching valve (21) is set to the first state, and the refrigeration cycle is performed in the refrigerant circuit (15). In the refrigerant circuit (15) during the cooling operation, the outdoor heat exchanger (22) functions as a condenser, and the indoor heat exchanger (23) functions as an evaporator. The indoor unit (12) blows air cooled in the indoor heat exchanger (23) into an indoor space.

In the heating operation, the four-way switching valve (21) is set to the second state, and the refrigeration cycle is performed in the refrigerant circuit (15). In the refrigerant circuit (15) during the heating operation, the indoor heat exchanger (23) functions as a condenser, and the outdoor heat exchanger (22) functions as an evaporator. The indoor unit (12) blows air heated in the indoor heat exchanger (23) into the indoor space.

—Control of Oil Return Valve by Controller—

Control of the oil return valve (46) performed by the outdoor controller (61) of the controller (60) will be described.

Figure 4:
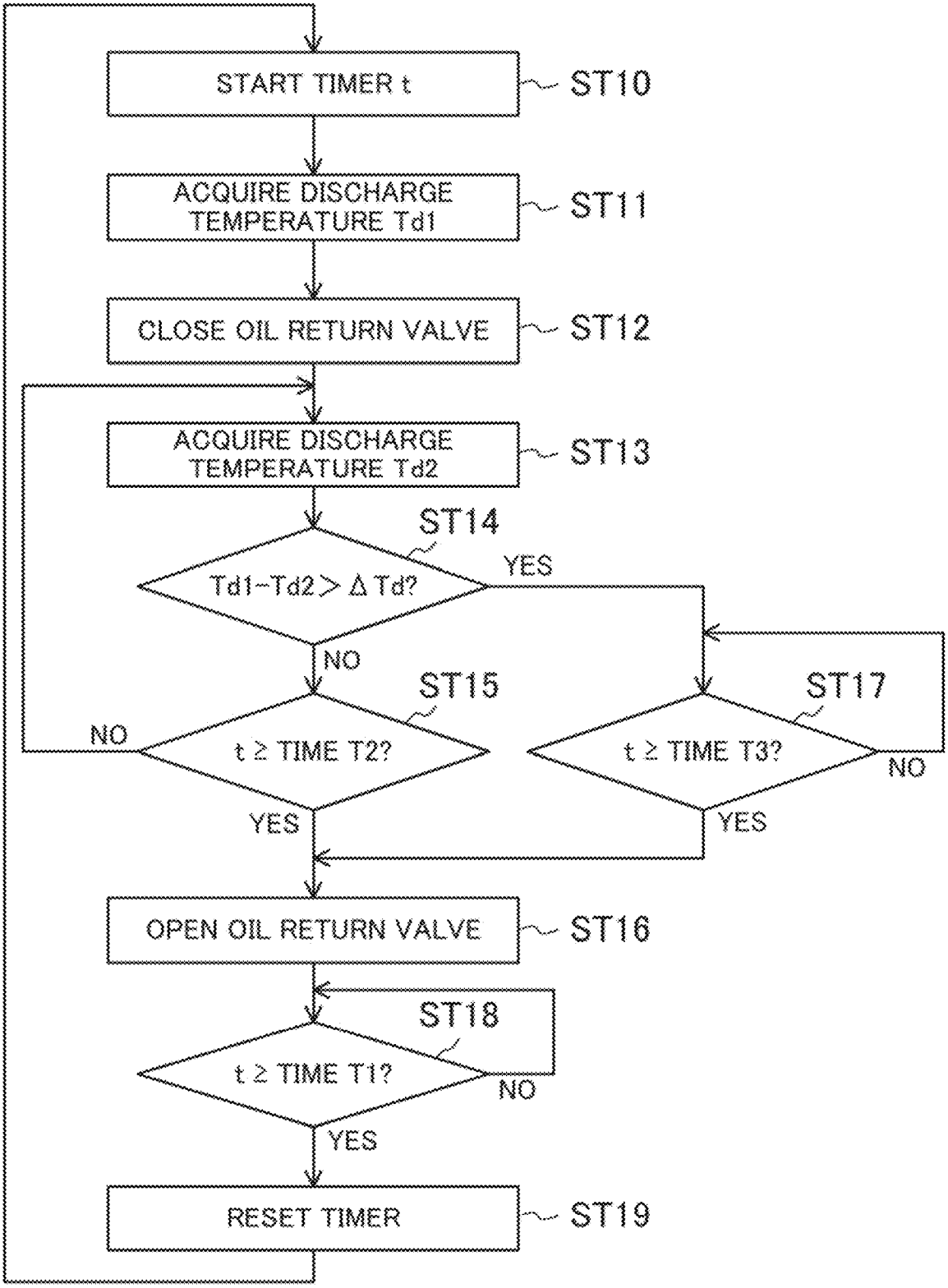
FIG. 4 is a flowchart showing operation of the controller of the first embodiment.

The outdoor controller (61) performs an operation shown in a flowchart of FIG. 4 as an operation of controlling the oil return valve (46). The outdoor controller (61) repeats the operation shown in the flowchart of FIG. 4 at predetermined time intervals T1 (15 minutes in this embodiment).

In the processing of Step ST10 in FIG. 4, the outdoor controller (61) starts counting up by a timer.

In the processing of next Step ST11, the outdoor controller (61) acquires the measured value by the discharge temperature sensor (50), and stores the acquired measured value as a discharge temperature Td1 in the memory device (63). The discharge temperature Td1 is the measured value by the discharge temperature sensor (50) before closing of the oil return valve (46) (in other words, in a state of the oil return valve (46) being open).

In the processing of next Step ST12, the outdoor controller (61) closes the oil return valves (46).

In the processing of next Step ST13, the outdoor controller (61) acquires the measured value by the discharge temperature sensor (50), and stores the acquired measured value as a discharge temperature Td2 in the memory device (63). The discharge temperature Td2 is the measured value by the discharge temperature sensor (50) after closing of the oil return valve (46).

In the processing of next Step ST14, the outdoor controller (61) determines whether or not a first condition is satisfied. The first condition is a condition that a difference (Td1-Td2) between the discharge temperature Td1 and the discharge temperature Td2 exceeds a predetermined value ΔTd (Td1-Td2>ΔTd). The predetermined value ΔTd is, for example, 2° C. If the first condition is satisfied, the outdoor controller (61) performs the processing of Step ST17. If the first condition is not satisfied, the outdoor controller (61) performs the processing of Step ST15.

In the processing of Step ST15, the outdoor controller (61) determines whether or not the measured time t by the timer has reached a predetermined time T2. If the measured time t is less than the time T2 (t<T2), the outdoor controller (61) performs the processing of Step ST13. If the measured time tis the time T2 or more (t≥T2), the outdoor controller (61) performs the processing of Step ST16. The time T2 is, for example, 10 seconds.

A series of processing from Step ST10 to Step ST15 is a detection operation performed by the outdoor controller (61). This detection operation is an operation of decreasing the opening degree of the oil return valve (46) and detecting whether or not the gas refrigerant is flowing through the oil return pipe (45) based on a change in the measured value by the discharge temperature sensor (50) after decreasing of the opening degree of the oil return valve (46) as compared to the measured value by the discharge temperature sensor (50) before decreasing of the opening degree of the oil return valve (46).

If the measured time t is the time T2 or more in the processing of Step ST15, the temperature difference (Td1-Td2) does not reach ΔTd even after a lapse of the time T2 since the oil return valve (46) has been closed. Thus, it can be determined that no gas refrigerant is flowing through the oil return pipe (45) (in other words, substantially only the refrigerating machine oil is flowing through the oil return pipe (45)).

Thus, in the processing of Step ST16, the outdoor controller (61) opens the oil return valve (46). When the oil return valve (46) is open, the refrigerating machine oil stayed in the oil separator (40) flows into the compressor (30) through the oil return pipe (45).

On the other hand, if the first condition is satisfied in the processing of Step ST14, it can be determined that mainly the gas refrigerant is flowing through the oil return pipe (45). In this state, part of the refrigerant having flowed out through the discharge pipe (36) of the compressor (30) flows into the suction pipe (35) of the compressor (30) through the oil return pipe (45). Thus, the flow rate of the refrigerant sent from the compressor unit (20) to the four-way switching valve (21) is lower than the flow rate of the refrigerant flowing out through the discharge pipe (36) of the compressor (30).

Thus, in the processing of Step ST17, the outdoor controller (61) stands by until the measured time t by the timer reaches a predetermined time T3. As a result, the oil return valve (46) is kept closed until the measured time t reaches the time T3. The time T3 is, for example, 8 minutes.

When the measured time t reaches the time T3 in the processing of Step ST17, the outdoor controller (61) performs the processing of Step ST16. When the measured time t reaches the time T3, the outdoor controller (61) temporarily opens the oil return valve (46) to determine again whether or not the gas refrigerant is flowing through the oil return pipe (45).

In the processing of next Step ST18, the outdoor controller (61) stands by until the measured time t by the timer reaches the predetermined time T1. As described above, the time T1 is, for example, 15 minutes. When the measured time t reaches the time T1, the outdoor controller (61) performs the processing of Step ST19.

In the processing of Step ST19, the outdoor controller (61) resets the measured time t by the timer. Thereafter, the outdoor controller (61) performs the processing of Step ST10 again.

—Operation of Oil Return Valve—

Figure 5:
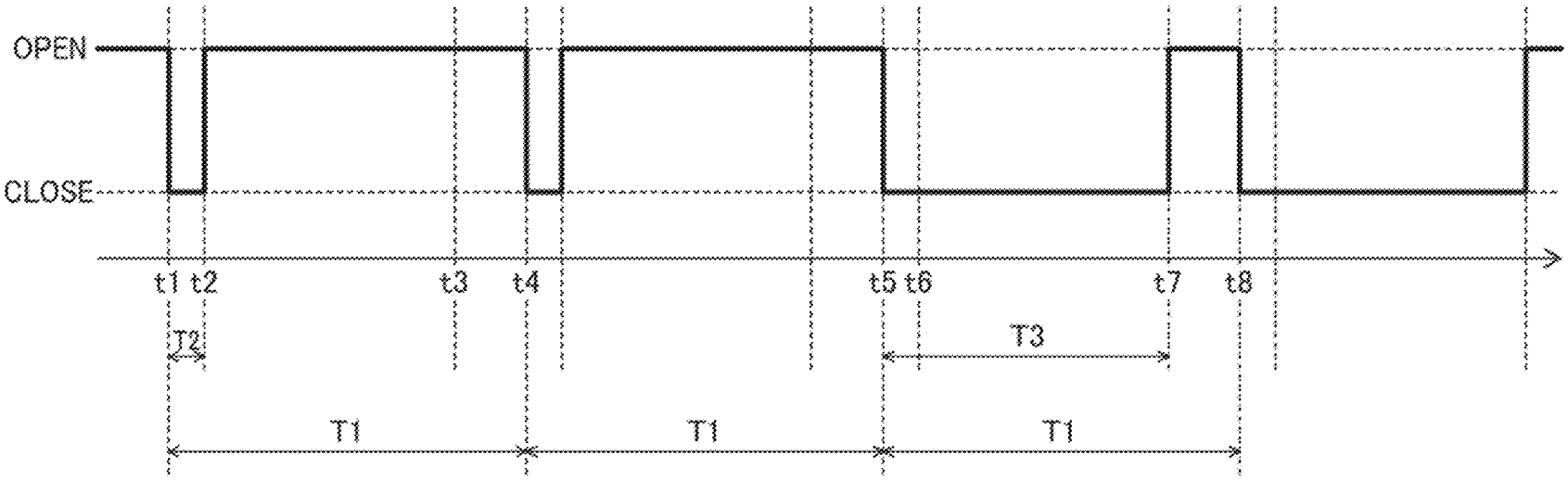
FIG. 5 is a timing chart showing the state of an oil return valve controlled by the controller of the first embodiment.

Operation of the oil return valve (46) controlled by the outdoor controller (61) will be described with reference to FIG. 5.

At a time t1, the outdoor controller (61) starts the detection operation. At the time t1, the outdoor controller (61) performs the processing of Step ST12, thereby closing the oil return valve (46). In the current detection operation, the first condition is not satisfied in the processing of Step ST14. Thus, at a time t2, the outdoor controller (61) performs the processing of Step ST16, thereby opening the oil return valve (46). The time t2 is a time when the time T2 has substantially elapsed from the time t1. The outdoor controller (61) performs the processing of Step ST18, whereby the oil return valve (46) is kept open until a time t4. The time t4 is a time when the time T1 has substantially elapsed from the time t1. At the time t4, the outdoor controller (61) starts the next detection operation.

At a time t5, the outdoor controller (61) starts the detection operation. At the time t5, the outdoor controller (61) performs the processing of Step ST12, thereby closing the oil return valve (46). In the current detection operation, the first condition is satisfied in the processing of Step ST14. Thus, the outdoor controller (61) performs the processing of Step ST17, whereby the oil return valve (46) is kept closed until a time t7. The time t7 is a time when the time T3 has substantially elapsed from the time t5. At the time t7, the outdoor controller (61) performs the processing of Step ST16, thereby opening the oil return valve (46). The outdoor controller (61) performs the processing of Step ST18, whereby the oil return valve (46) is kept open until a time t8. The time t8 is a time when the time T1 has substantially elapsed from the time t5. At the time t8, the outdoor controller (61) starts the next detection operation.

—Recovery Operation of Controller—

The outdoor controller (61) of the controller (60) performs a recovery operation when a predetermined recovery condition is satisfied. The recovery operation is an operation of returning the refrigerating machine oil staying outside the compressor unit (20) to the compressor unit (20). The recovery condition is, for example, a condition that the cumulative operation time of the air conditioner (10) reaches a predetermined value (e.g., two hours).

<Recovery Operation>

The outdoor controller (61) performs an operation of temporarily maximizing the rotational speed of the compressor (30) as the recovery operation. When the outdoor controller (61) performs the recovery operation, the flow velocity of the refrigerant flowing through the refrigerant circuit (15) increases, and the refrigerating machine oil staying outside the compressor unit (20) is washed away by the refrigerant and returns to the compressor unit (20) together with the refrigerant.

The outdoor controller (61) may be configured to perform, as the recovery operation, an operation of increasing the opening degree of the indoor expansion valve (25) during the cooling operation or an operation of increasing the opening degree of the outdoor expansion valve (24) during the heating operation. In a case where the opening degree of the indoor expansion valve (25) is increased during the cooling operation and a case where the opening degree of the outdoor expansion valve (24) is increased during the heating operation, the refrigerant sucked into the compressor (30) is in a wet state. Thus, the refrigerating machine oil staying outside the compressor unit (20) returns to the compressor unit (20) in a state of being dissolved in the liquid refrigerant.

<Forcible Execution of Recovery Operation>

When the outdoor controller (61) of the controller (60) determines that the gas refrigerant is flowing through the oil return pipe (45) in the detection operation in a case where the rotational speed of the compressor (30) is a predetermined value (e.g., 80% of the maximum rotational speed) or more, the outdoor controller (61) performs the recovery operation even if the recovery condition is not satisfied.

When the rotational speed of the compressor (30) is relatively high, the amount of refrigerating machine oil flowing out of the compressor (30) together with the refrigerant is normally relatively great. Thus, when the rotational speed of the compressor (30) is relatively high, mainly the refrigerating machine oil normally flows through the oil return pipe (45). For this reason, in a case where mainly the gas refrigerant is flowing through the oil return pipe (45) even though the rotational speed of the compressor (30) is relatively high, the amount of refrigerating machine oil stored in the compressor (30) is likely to be small. Thus, in this case, the outdoor controller (61) performs the recovery operation of returning the refrigerating machine oil staying outside the compressor unit (20) to the compressor unit (20) regardless of whether or not the recovery condition is satisfied in order to quickly increase the amount of refrigerating machine oil stored in the compressor (30).

<Inhibiting of Recovery Operation>

When the outdoor controller (61) of the controller (60) does not determine that the gas refrigerant is flowing through the oil return pipe (45) in the detection operation in a case where the rotational speed of the compressor (30) is a predetermined value (e.g., 30% of the maximum rotational speed) or less, the outdoor controller (61) does not perform the recovery operation even if the recovery condition is satisfied. That is, in this case, the recovery operation of the outdoor controller (61) is inhibited.

When the rotational speed of the compressor (30) is relatively low, the amount of refrigerating machine oil flowing out of the compressor (30) together with the refrigerant is small. Thus, when no gas refrigerant is flowing through the oil return pipe (45) (i.e., mainly the refrigerating machine oil is flowing through the oil return pipe (45)) in a case where the rotational speed of the compressor (30) is the predetermined value or less, a sufficient amount of refrigerating machine oil is likely to be stored in the compressor (30). For this reason, in this case, it is not necessary to increase the amount of refrigerating machine oil stored in the compressor (30). Thus, in this case, the outdoor controller (61) does not perform the recovery operation even if the recovery condition is satisfied.

—First Condition—

A reason why it can be determined that the gas refrigerant is flowing through the oil return pipe (45) in a case where the first condition is satisfied will be described with reference to a Mollier diagram (pressure-enthalpy diagram) of FIG. 6.

Figure 6:
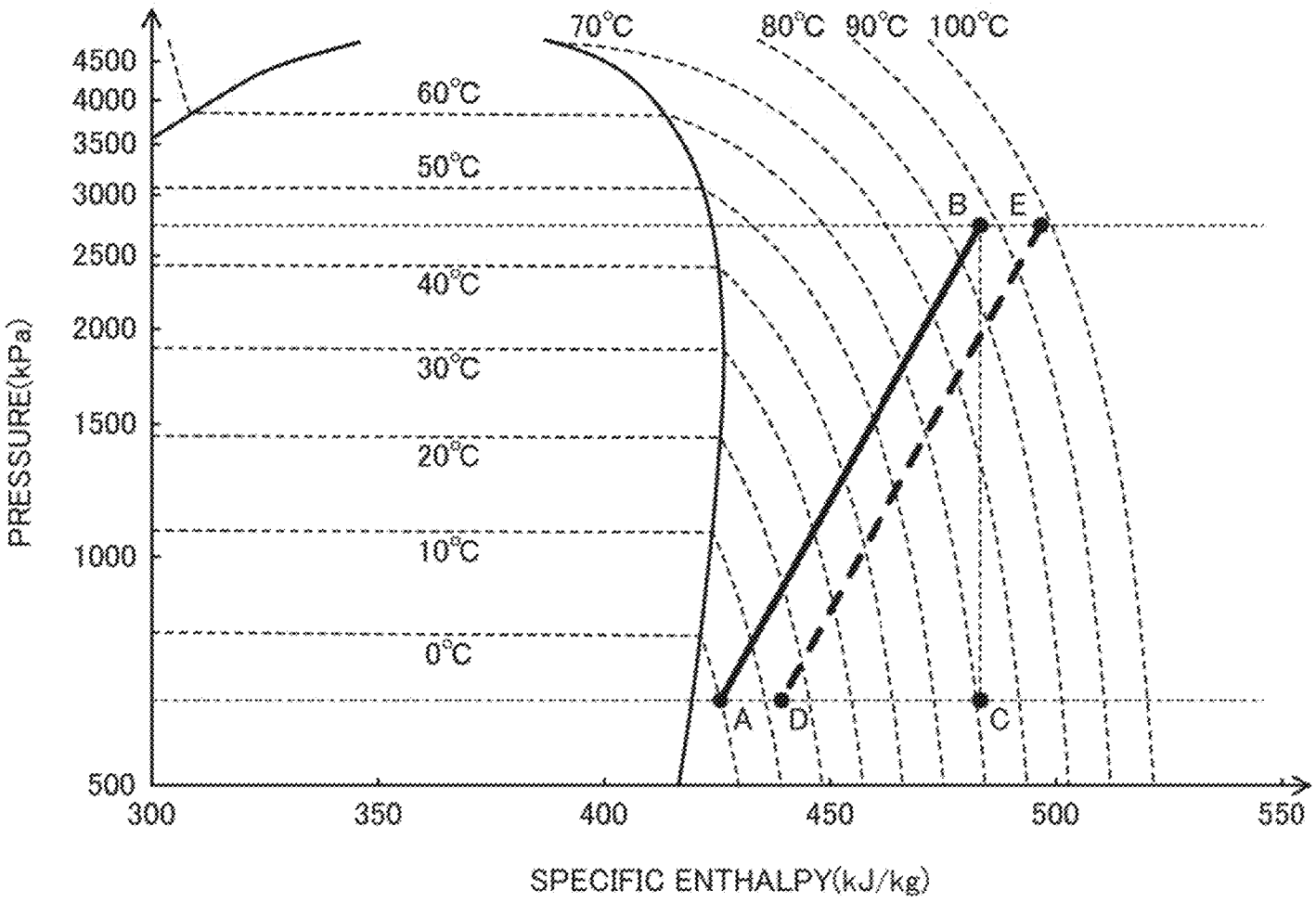
FIG. 6 is a Mollier diagram for describing a first condition.

In FIG. 6, a process from a point A to a point B (indicated by a solid line) indicates a compression phase of the compressor (30) in a case where the oil return valve (46) is closed. In this state, the compression mechanism (32) of the compressor (30) sucks and compresses the refrigerant in the state of the point A, and discharges the refrigerant compressed into the state of the point B.

In this state, it is assumed that the oil return valve (46) is open and mainly the gas refrigerant flows through the oil return pipe (45). In this case, the gas refrigerant in the state of the point B, which has flowed from the oil separator (40) into the oil return pipe (45), is adiabatically expanded into the state of the point C when passing through the capillary tube (47). The refrigerant in the state of the point C is sucked into the compression mechanism (32) together with the refrigerant in the state of the point A. The refrigerant mixture of the refrigerant in the state of the point A and the refrigerant in the state of the point C is in the state of a point D. The compression mechanism (32) sucks and compresses the refrigerant in the state of the point D. The refrigerant in the state of the point D is compressed into the state of a point E in the compression mechanism (32). In a state in which the oil return valve (46) is open and mainly the gas refrigerant flows through the oil return pipe (45), the compression phase of the compressor (30) is a process from the point D to the point E (indicated by a broken line).

Here, it is assumed that the outdoor controller (61) starts the detection operation to close the oil return valve (46) in a state in which mainly the gas refrigerant is flowing through the oil return pipe (45). Then, the compression phase of the compressor (30) changes from the process from the point D to the point E to the process from the point A to the point B. Accordingly, the state of the refrigerant discharged from the compressor (30) changes from the state of the point E to the state of the point B. The temperature of the refrigerant in the state of the point B is lower than the temperature of the refrigerant in the state of the point E. Thus, when the outdoor controller (61) starts the detection operation to close the oil return valve (46) in a state in which mainly the gas refrigerant is flowing through the oil return pipe (45), the temperature of the refrigerant discharged from the compression mechanism (32) decreases.

Thus, in the detection operation, the outdoor controller (61) of this embodiment determines that the gas refrigerant is flowing through the oil return pipe (45) when the first condition that "the measured value Td2 of the discharge temperature sensor (50) after the oil return valve (46) has been closed is smaller than the measured value Td1 of the discharge temperature sensor (50) before the oil return valve (46) is closed by the predetermined value (ΔTd) or more" is satisfied.

Feature (1) of First Embodiment

In the air conditioner (10) of this embodiment, the outdoor controller (61) of the controller (60) performs the detection operation. In the detection operation, the outdoor controller (61) decreases the opening degree of the oil return valve (46), and detects whether or not the gas refrigerant is flowing through the oil return pipe (45) based on the change in the measured value by the discharge temperature sensor (50) after the decreasing of the opening degree of the oil return valve (46) as compared to the measured value by the discharge temperature sensor (50) before the decreasing of the opening degree of the oil return valve (46).

In the detection operation, the outdoor controller (61) detects whether or not the gas refrigerant is flowing through the oil return pipe (45) based on the relative change in the measured value by the discharge temperature sensor (50) before and after the change in the opening degree of the oil return valve (46). The cause of the change in the measured value by the discharge temperature sensor (50) in the detection operation of the outdoor controller (61) is substantially only the "change in the opening degree of the oil return valve (46)." Thus, according to this embodiment, the outdoor controller (61) performs the detection operation, thereby accurately detecting whether or not the gas refrigerant is flowing through the oil return pipe (45).

Feature (2) of First Embodiment

In the air conditioner (10) of this embodiment, when the outdoor controller (61) of the controller (60) determines, in the detection operation, that the gas refrigerant is flowing through the oil return pipe (45), the outdoor controller (61) keeps the oil return valve (46) closed for the predetermined time. When the oil return valve (46) is in the closed state, all the refrigerant discharged from the compressor (30) flows out of the compressor unit (20) to the four-way switching valve (21). Thus, according to this embodiment, the flow rate of the refrigerant having flowed out of the compressor unit (20) and circulating in the refrigerant circuit (15) can be kept high, and the air conditioning capacity of the air conditioner (10) can be kept high.

Feature (3) of First Embodiment

In the air conditioner (10) of this embodiment, when the outdoor controller (61) of the controller (60) determines that the gas refrigerant is flowing through the oil return pipe (45) in the detection operation in a case where the rotational speed of the compressor (30) is relatively high, the outdoor controller (61) performs the recovery operation even if the recovery condition is not satisfied. This makes it possible to quickly increase the amount of refrigerating machine oil stored in the compressor (30) and prevent damage to the compressor (30) due to poor lubrication.

Feature (4) of First Embodiment

In the air conditioner (10) of this embodiment, when the outdoor controller (61) of the controller (60) does not determine that the gas refrigerant is flowing through the oil return pipe (45) in the detection operation in a case where the rotational speed of the compressor (30) is relatively low, the outdoor controller (61) does not perform the recovery operation even if the recovery condition is satisfied. This makes it possible to prevent unnecessary execution of the recovery operation in advance.

Second Embodiment

A second embodiment will be described. An air conditioner (10) of this embodiment is a modified version of the air conditioner (10) of the first embodiment, in which the controller (60) is changed.

—Control of Oil Return Valve by Controller—

The controller (60) of this embodiment is different from the controller (60) of the first embodiment in the control of the oil return valve (46) performed by the outdoor controller (61). Here, the control of the oil return valve (46) performed by the outdoor controller (61) of this embodiment will be described with reference to a flowchart of FIG. 7.

Figure 7:
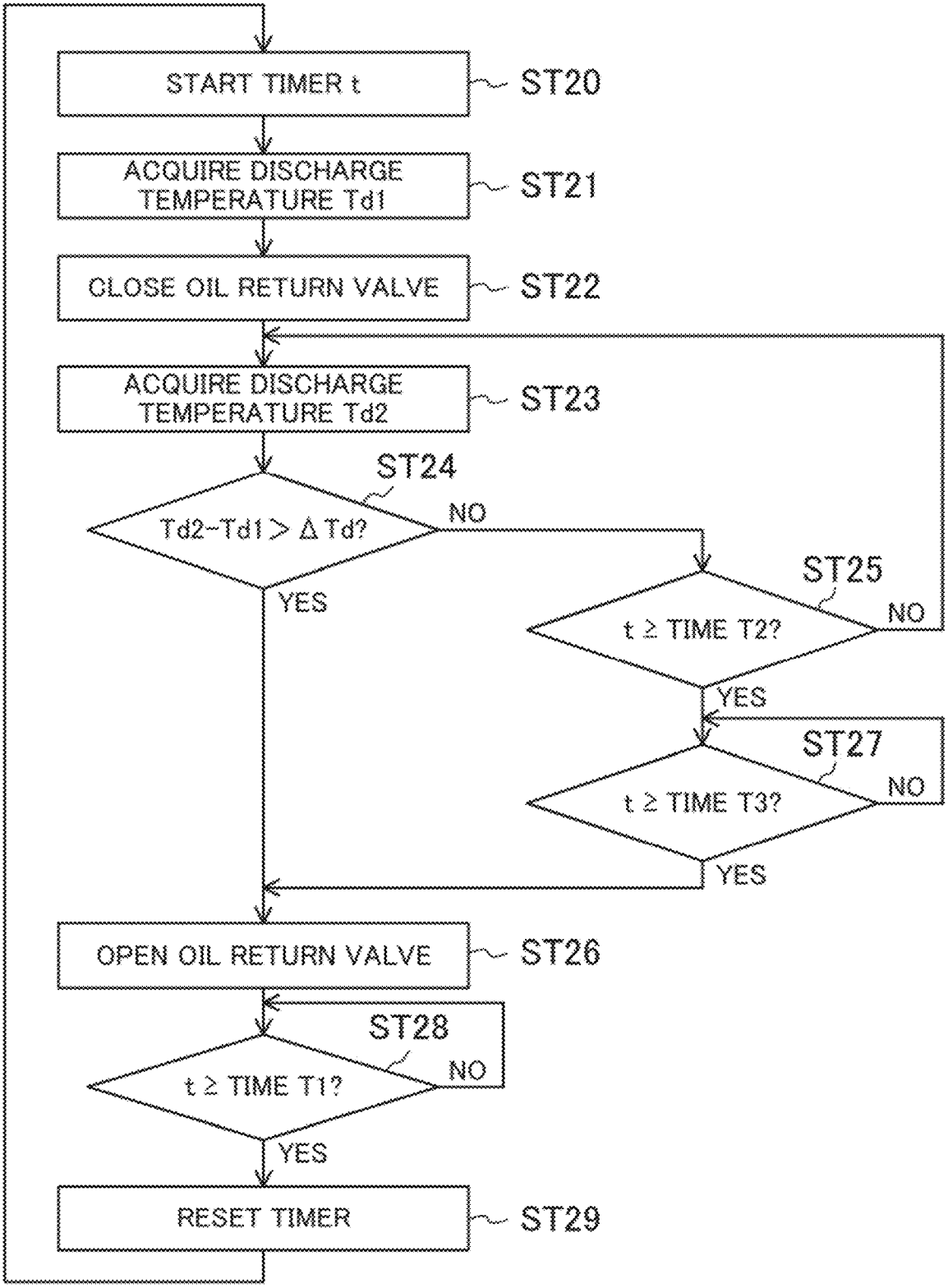
FIG. 7 is a flowchart showing operation of a controller of a second embodiment.

The outdoor controller (61) repeats the operation shown in the flowchart of FIG. 7 at predetermined time intervals T1 (15 minutes in this embodiment).

The processing from Step ST20 to Step ST23 in the flowchart of FIG. 7 is the same as the processing from Step ST10 to Step ST13 in the flowchart of FIG. 4. Moreover, the processing in Steps ST28, ST29 in the flowchart of FIG. 7 is the same as the processing in Steps ST18, ST19 in the flowchart of FIG. 4. Here, the processing from Step ST24 to Step ST27 will be described.

In the processing of Step ST24, the outdoor controller (61) determines whether or not a second condition is satisfied. The second condition is a condition that a difference (Td2-Td1) between the discharge temperature Td2 and the discharge temperature Td1 exceeds the predetermined value ΔTd (Td2-Td1>ΔTd). The predetermined value ΔTd is, for example, 2° C. If the second condition is satisfied, the outdoor controller (61) performs the processing of Step ST26. If the second condition is not satisfied, the outdoor controller (61) performs the processing of Step ST25.

If the second condition is satisfied in the processing of Step ST24, it can be determined that no gas refrigerant is flowing through the oil return pipe (45) (in other words, only the refrigerating machine oil substantially is flowing through the oil return pipe (45)).

Thus, in the processing of Step ST26, the outdoor controller (61) opens the oil return valve (46). When the oil return valve (46) is open, the refrigerating machine oil stayed in the oil separator (40) flows into the compressor (30) through the oil return pipe (45).

In the processing of Step ST25, the outdoor controller (61) determines whether or not the measured time t of the timer has reached the predetermined time T2. If the measured time t is less than the time T2 (t<T2), the outdoor controller (61) performs the processing of Step ST23. If the measured time t is the time T2 or more (t≥T2), the outdoor controller (61) performs the processing of Step ST27. The time T2 is, for example, 10 seconds.

If the measured time t is the time T2 or more in the processing of Step ST25, the temperature difference (Td2-Td1) does not reach ΔTd even after a lapse of the time T2 since the oil return valve (46) was closed. Thus, it can be determined that the gas refrigerant is flowing through the oil return pipe (45).

Thus, in the processing of Step ST27, the outdoor controller (61) stands by until the measured time t of the timer reaches the predetermined time T3. As a result, the oil return valve (46) is kept closed until the measured time t reaches the time T3. The time T3 is, for example, 8 minutes.

When the measured time t reaches the time T3 in the processing of Step ST27, the outdoor controller (61) performs the processing of Step ST26. When the measured time t reaches the time T3, the outdoor controller (61) temporarily opens the oil return valve (46) to determine again whether or not the gas refrigerant is flowing through the oil return pipe (45).

—Second Condition—

A reason why it can be determined that the gas refrigerant is flowing through the oil return pipe (45) when the second condition is not satisfied will be described with reference to a Mollier diagram (pressure-enthalpy diagram) of FIG. 8.

Figure 8:
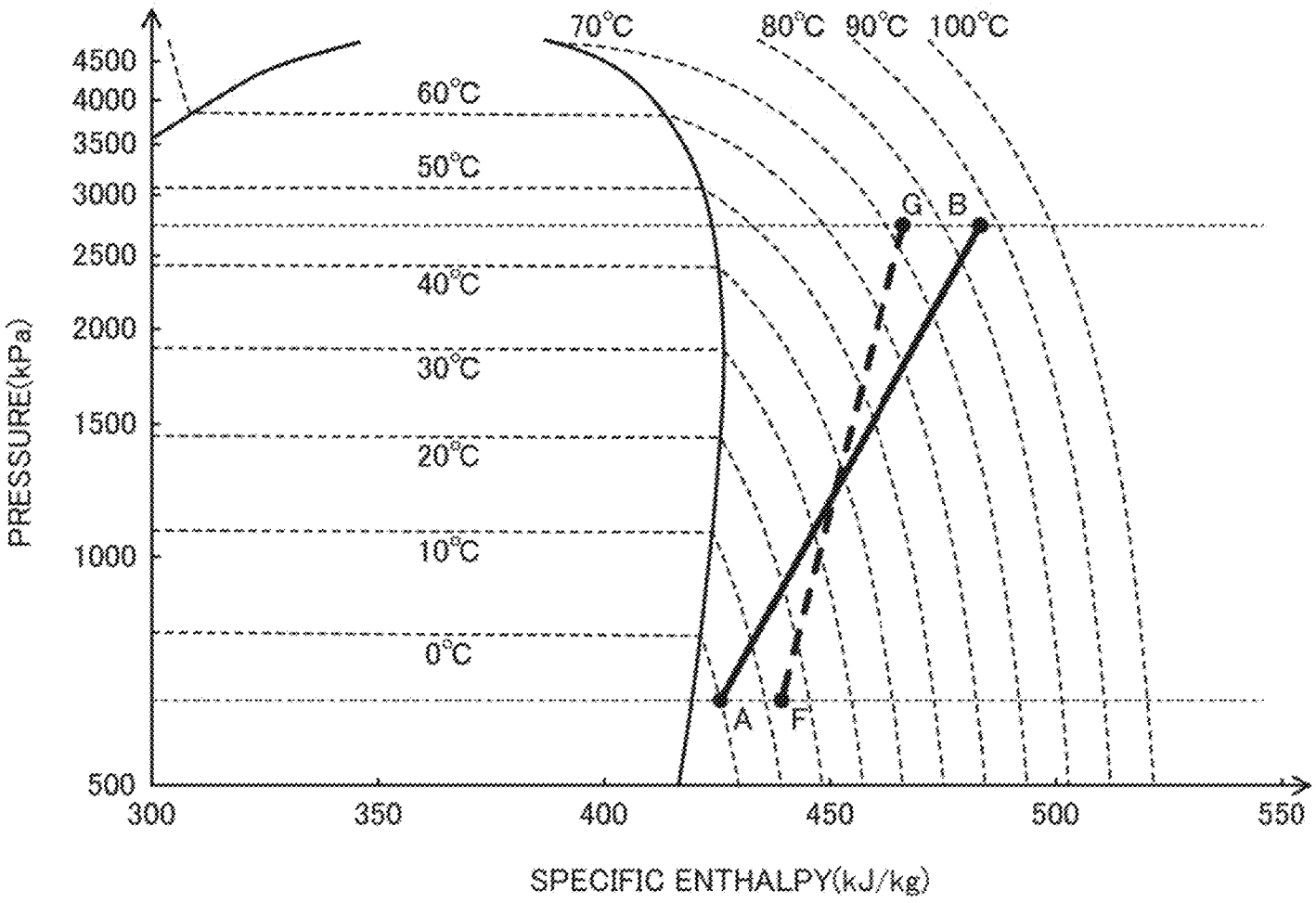
FIG. 8 is a Mollier diagram for describing a second condition.

In FIG. 8, a process from a point A to a point B (indicated by a solid line) indicates the compression phase of the compressor (30) when the oil return valve (46) is closed. In this state, the compression mechanism (32) sucks and compresses the refrigerant in the state of the point A, and discharges the refrigerant compressed into the state of the point B.

In this state, it is assumed that the oil return valve (46) is open and mainly the refrigerating machine oil flows through the oil return pipe (45). The temperature of the refrigerating machine oil flowing from the oil separator (40) into the oil return pipe (45) is substantially equal to the temperature of the refrigerant discharged from the compressor (30) (i.e., the refrigerant in the state of the point B). The refrigerating machine oil is not adiabatically expanded when passing through the capillary tube (47). Thus, the temperature of the refrigerating machine oil does not decrease while the refrigerating machine oil is passing through the capillary tube (47). When the high-temperature refrigerating machine oil having passed through the oil return pipe (45) joins the refrigerant in the state of the point A, the refrigerant is brought into the state of a point F. The compression mechanism (32) sucks and compresses the refrigerant in the state of the point F.

The refrigerant in the state of the point F is compressed into the state of a point G in the compression mechanism (32). In the compression phase of the compression mechanism (32), the refrigerating machine oil does not receive the compression work. For this reason, part of heat held by the compressed refrigerant is consumed to increase the temperature of the refrigerating machine oil. Thus, the refrigerant in the state of the point G has a lower specific enthalpy than that of the refrigerant in the state of the point B. In a state in which the oil return valve (46) is open and mainly the refrigerating machine oil is flowing through the oil return pipe (45), the compression phase of the compressor (30) is a process from the point F to the point G (indicated by a broken line).

Here, it is assumed that the outdoor controller (61) starts the detection operation to close the oil return valve (46) in a state in which mainly the refrigerating machine oil is flowing through the oil return pipe (45). Then, the compression phase of the compressor (30) changes from the process from the point F to the point G to the process from the point A to the point B. Accordingly, the state of the refrigerant discharged from the compression mechanism (32) changes from the state of the point G to the state of the point B. The temperature of the refrigerant in the state of the point B is higher than the temperature of the refrigerant in the state of the point G. Thus, when the outdoor controller (61) starts the detection operation to close the oil return valve (46) in a state in which mainly the refrigerating machine oil is flow through the oil return pipe (45), the temperature of the refrigerant discharged from the compression mechanism (32) increases.

Thus, in the detection operation, the outdoor controller (61) of this embodiment determines that the gas refrigerant is flowing through the oil return pipe (45) in a case where the second condition that "the measured value Td2 by the discharge temperature sensor (50) after the oil return valve (46) has been closed is greater than the measured value Td1 by the discharge temperature sensor (50) before the oil return valve (46) is closed by the predetermined value (ΔTd) or more" is not satisfied.

Third Embodiment

A third embodiment will be described. Thus, the following description will be focused on differences between an air conditioner (10) of this embodiment and the air conditioner (10) of the first embodiment.

Figure 9:
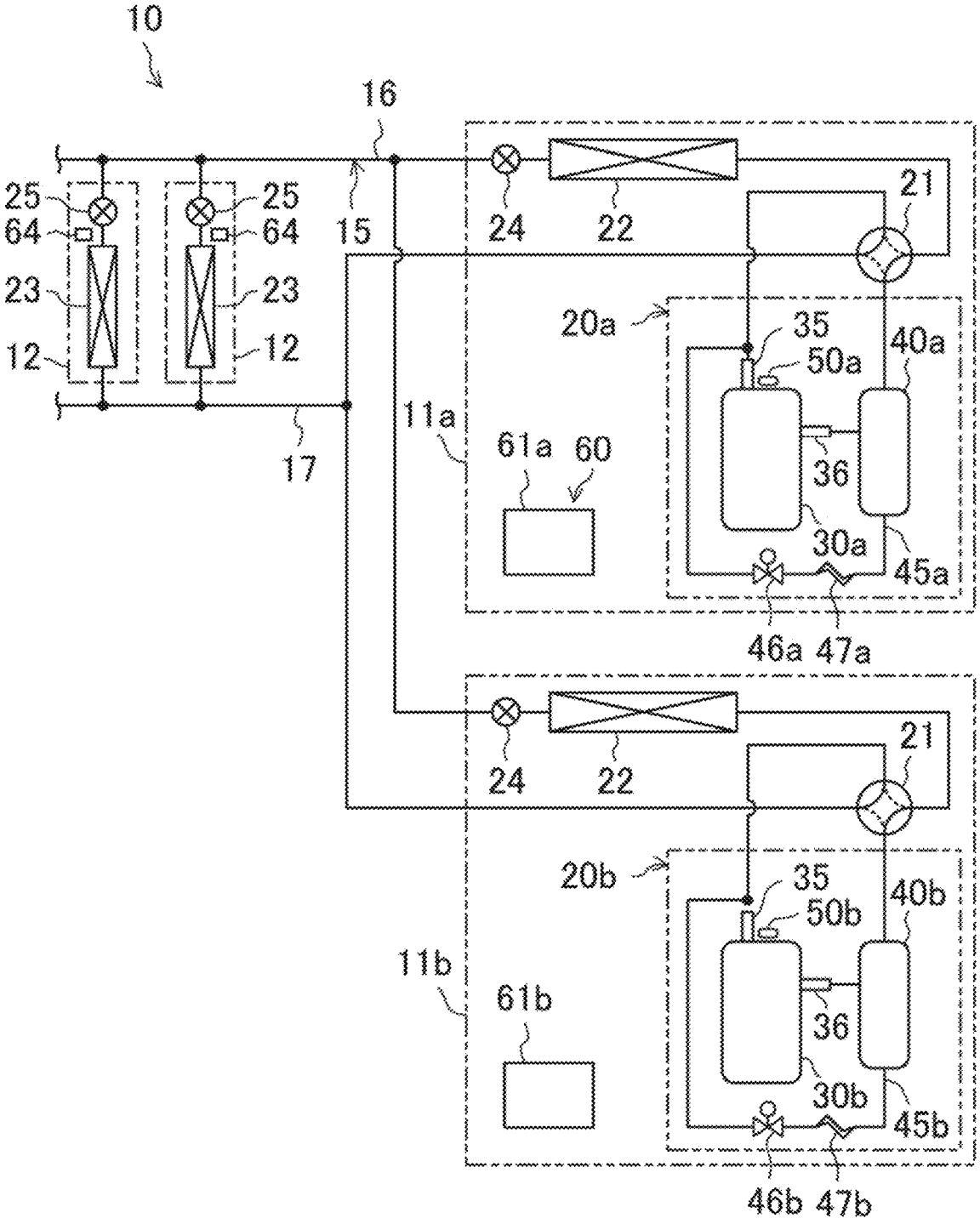
FIG. 9 is a refrigerant circuit diagram illustrating the configuration of an air conditioner according to a third embodiment.

As illustrated in FIG. 9, the air conditioner (10) of this embodiment includes two outdoor units (11*a*, 11*b*). In the refrigerant circuit (15), the two outdoor units (11*a*, 11*b*) are connected in parallel to each other. Each of the outdoor units (11*a*, 11*b*) has the same configuration as that of the outdoor unit (11) of the first embodiment.

Each outdoor unit (11*a*, 11*b*) includes a single compressor unit (20*a*, 20*b*). The first outdoor unit (11*a*) includes the first compressor unit (20*a*), and the second outdoor unit (11*b*) includes the second compressor unit (20*b*).

The configuration of each of the compressor units (20*a*, 20*b*) is the same as that of the compressor unit (20) of the first embodiment. Each compressor unit (20*a*, 20*b*) includes a compressor (30*a*, 30*b*), an oil separator (40*a*, 40*b*), an oil return pipe (45*a*, 45*b*), and a discharge temperature sensor (50*a*, 50*b*) The oil return pipe (45*a*, 45*b*) of each compressor unit (20*a*, 20*b*) is provided with a capillary tube (47*a*, 47*b*) and an oil return valve (46*a*, 46*b*).

Each outdoor unit (11*a*, 11*b*) includes a single outdoor controller (61*a*, 61*b*). The controller (60) of this embodiment includes the outdoor controllers (61*a*, 61*b*) of the outdoor units (11*a*, 11*b*) and the indoor controllers (64) of the indoor units (12).

Each of the outdoor controllers (61*a*, 61*b*) performs the operation shown in the flowchart of FIG. 4 for the corresponding compressor unit (20*a*, 20*b*). In the first outdoor unit (11*a*), the outdoor controller (61*a*) performs the operation shown in the flowchart of FIG. 4 for the first compressor unit (20*a*). The outdoor controller (61*a*) performs the detection operation using the measured value by the discharge temperature sensor (50*a*). On the other hand, in the second outdoor unit (11*b*), the outdoor controller (61*b*) performs the operation shown in the flowchart of FIG. 4 for the second compressor unit (20*b*). The outdoor controller (61*b*) performs the detection operation using the measured value by the discharge temperature sensor (50*b*).

—Transfer Operation of Controller—

The controller (60) of this embodiment performs a transfer operation. The transfer operation is an operation of transferring the refrigerating machine oil from the compressor unit (20*a*, 20*b*) in which the storage amount of the refrigerating machine oil is relatively great to the compressor unit (20*a*, 20*b*) in which the storage amount of the refrigerating machine oil is relatively small.

Specifically, in a case where the storage amount of the refrigerating machine oil of the first compressor unit (20*a*) is relatively great and the storage amount of the refrigerating machine oil of the second compressor unit (20*b*) is relatively small, the controller (60) performs a transfer operation of transferring the refrigerating machine oil from the first compressor unit (20*a*) to the second compressor unit (20*b*). In a case where the storage amount of the refrigerating machine oil of the second compressor unit (20*b*) is relatively great and the storage amount of the refrigerating machine oil of the first compressor unit (20*a*) is relatively small, the controller (60) performs a transfer operation of transferring the refrigerating machine oil from the second compressor unit (20*b*) to the first compressor unit (20*a*).

Here, the transfer operation of the controller (60) will be described by taking, as an example, a case where the storage amount of the refrigerating machine oil of the first compressor unit (20*a*) is relatively great and the storage amount of the refrigerating machine oil of the second compressor unit (20*b*) is relatively small.

In this case, the outdoor controller (61*b*) of the second outdoor unit (11*b*) performs the detection operation based on the measured value by the discharge temperature sensor (50*b*), and determines that mainly the gas refrigerant is flowing through the oil return pipe (45*b*) of the second compressor unit (20*b*). Then, the outdoor controller (61*b*) outputs an oil shortage signal.

In this case, the outdoor controller (61*a*) by the first outdoor unit (11*a*) performs the detection operation based on the measured value by the discharge temperature sensor (50*a*), and determines that no gas refrigerant is flowing through the oil return pipe (45*a*) of the first compressor unit (20*a*). The outdoor controller (61*a*) performs the transfer operation when receiving the oil shortage signal output from the outdoor controller (61*b*) of the second outdoor unit (11*b*).

In the transfer operation, the outdoor controller (61*a*) of the first outdoor unit (11*a*) increases the rotational speed of the compressor (30*a*) of the first compressor unit (20*a*) by a predetermined value. Moreover, in the transfer operation, the outdoor controller (61*a*) sends, to the outdoor controller (61*b*) of the second outdoor unit (11*b*), a command signal for decreasing the rotational speed of the compressor (30*b*) of the second compressor unit (20*b*). The outdoor controller (61*b*) having received the command signal decreases the rotational speed of the compressor (30*b*) of the second compressor unit (20*b*) by the predetermined value.

In the transfer operation, when the controller (60) increases the rotational speed of the compressor (30*a*) of the first compressor unit (20*a*), the flow rate of the refrigerating machine oil discharged from the compressor (30*a*) together with the refrigerant increases. Moreover, in the transfer operation, when the controller (60) decreases the rotational speed of the compressor (30*b*) of the second compressor unit (20*b*), the flow rate of the refrigerating machine oil discharged from the compressor (30*b*) together with the refrigerant decreases. Thus, when the controller (60) performs the transfer operation, the amount of refrigerating machine oil stored in the compressor (30*a*) of the first compressor unit (20*a*) decreases, and the amount of refrigerating machine oil stored in the compressor (30*b*) of the second compressor unit (20*b*) increases.

In this transfer operation, the rotational speed of the compressor (30*a*) of the first compressor unit (20*a*) increases, whereas the rotational speed of the compressor (30*b*) of the second compressor unit (20*b*) decreases. Thus, the flow rate of the refrigerant circulating in the refrigerant circuit (15) during execution of the transfer operation is equal to the flow rate of the refrigerant circulating in the refrigerant circuit (15) before the start of the transfer operation. Thus, the air conditioning capacity exhibited by the air conditioner (10) during execution of the transfer operation is kept equal to the air conditioning capacity exhibited by the air conditioner (10) before the start of the transfer operation.

Features of Third Embodiment

In the air conditioner (10) of this embodiment, the controller (60) performs the transfer operation, and this makes it possible to transfer the refrigerating machine oil from the compressor unit (20*a*, 20*b*) in which the storage amount of the refrigerating machine oil is relatively great to the compressor unit (20*a*, 20*b*) in which the storage amount of the refrigerating machine oil is relatively small. This makes it possible to equalize the storage amount of the refrigerating machine oil in all the compressor units (20*a*, 20*b*) and to ensure the reliability of the compressor (30*a*, 30*b*) of each of the compressor units (20*a*, 20*b*).

OTHER EMBODIMENTS

In the air conditioners (10) of the first to third embodiments, the oil return valve (46) may be an electric valve with a variable opening degree. The air conditioner (10) of this variation will be described by taking, as an example, a case where this variation is applied to the air conditioner (10) of the first embodiment.

The outdoor controller (61) provided for the air conditioner (10) of this variation may change the opening degree of the oil return valve (46) from the maximum opening degree (fully opened) to the minimum opening degree (fully closed) or may decrease the opening degree of the oil return valve (46) from a first opening degree to a second opening degree in the processing of Step ST12 in FIG. 4. The first opening degree and the second opening degree satisfy a relationship of (the minimum opening degree<the second opening degree<the first opening degree<the maximum opening degree).

In a case where the outdoor controller (61) decreases the opening degree of the oil return valve (46) from the first opening degree to the second opening degree in the processing of Step ST12, the outdoor controller (61) may increase the opening degree of the oil return valve (46) from the second opening degree to a third opening degree in the processing of Step ST16 in FIG. 4. The third opening degree is greater than the first opening degree. The first opening degree and the third opening degree satisfy a relationship of (the first opening degree<the third opening degree≤the maximum opening degree).

In a case where the outdoor controller (61) decreases the opening degree of the oil return valve (46) from the first opening degree to the second opening degree in the processing of Step ST12, the outdoor controller (61) may perform the processing of Step ST17 after having decreased the opening degree of the oil return valve (46) from the second opening degree to a fourth opening degree when the first condition is satisfied in Step ST14 of FIG. 4. The second opening degree and the fourth opening degree satisfy a relationship of (the minimum opening degree<the fourth opening degree<the second opening degree).

While the embodiments and variations thereof have been described above, it will be understood that various changes in form and details may be made without departing from the spirit and scope of the claims. The elements according to embodiments, the variations thereof, and the other embodiments may be combined and replaced with each other. In addition, the expressions of "first," "second," "third," . . . , in the specification and claims are used to distinguish the terms to which these expressions are given, and do not limit the number and order of the terms.

INDUSTRIAL APPLICABILITY

As described above, the present disclosure is useful for an air conditioner.

EXPLANATION OF REFERENCES

10 Air Conditioner (Refrigeration Apparatus)
15 Refrigerant Circuit
20 Compressor Unit
20*a* First Compressor Unit
20*b* Second Compressor Unit
30 Compressor
31 Casing
32 Compression Mechanism
33 Electric Motor
35 Suction Pipe
40 Oil Separator
45 Oil Return Pipe
46 Oil Return Valve
50 Discharge Temperature Sensor
60 Controller

The invention claimed is:

1. A refrigeration apparatus including a refrigerant circuit having a compressor unit and configured to perform a refrigeration cycle, the compressor unit having a compressor with a compression mechanism configured to compress and discharge refrigerant, an oil separator configured to separate refrigerating machine oil from a gas refrigerant discharged from the compressor, an oil return pipe connecting the oil separator to a suction pipe of the compressor, an oil return valve provided for the oil return pipe, and a discharge temperature sensor configured to measure a temperature of the gas refrigerant discharged from the compression mechanism, the refrigeration apparatus comprising:

a controller configured to perform a detection operation of decreasing an opening degree of the oil return valve and detecting whether or not gas refrigerant is flowing through the oil return pipe based on a change in a measured value by the discharge temperature sensor after the decreasing of the opening degree of the oil return valve as compared to a measured value by the discharge temperature sensor before the decreasing of the opening degree of the oil return valve.

2. The refrigeration apparatus of claim 1, wherein the detection operation performed by the controller includes an operation of determining that the gas refrigerant is flowing through the oil return pipe when a first condition is satisfied, and the first condition is a condition that the measured value by the discharge temperature sensor after the decreasing of the opening degree of the oil return valve is smaller, by a predetermined value or more, than the measured value by the discharge temperature sensor before the decreasing of the opening degree of the oil return valve.

3. The refrigeration apparatus of claim 2, wherein the controller keeps the opening degree of the oil return valve at the opening degree after the decreasing or further decreasing of the opening degree of the oil return valve when the first condition is satisfied in the detection operation.

4. The refrigeration apparatus of claim 1, wherein the detection operation performed by the controller includes an operation of determining that the gas refrigerant is flowing through the oil return pipe when a second condition is not satisfied, and the second condition is a condition that the measured value by the discharge temperature sensor after the decreasing of the opening degree of the oil return valve is greater, by a predetermined value or more, than the measured value by the discharge temperature sensor before the decreasing of the opening degree of the oil return valve.

5. The refrigeration apparatus of claim 4, wherein the controller returns the opening degree of the oil return valve to the opening degree before the decreasing or increasing of the opening degree of the oil return valve as compared to the opening degree before the decreasing when the second condition is satisfied in the detection operation.

6. The refrigeration apparatus of claim 1, wherein the compressor has an electric motor configured to drive the compression mechanism, and a casing housing the compression mechanism and the electric motor, and the discharge temperature sensor measures a temperature of gas refrigerant discharged from the compression mechanism into an internal space of the casing before passing by the electric motor.

7. The refrigeration apparatus of claim 1, wherein the compressor unit of the refrigerant circuit includes a plurality of compressor units, and the controller performs the detection operation for each of the plurality of compressor units.

8. The refrigeration apparatus of claim 7, wherein the plurality of compressor units provided for the refrigerant circuit includes a first compressor unit and a second compressor unit, and the controller performs a transfer operation of transferring refrigerating machine oil from the first compressor unit to the second compressor unit when the controller determines, in the detection operation, that the gas refrigerant is flowing through the oil return pipe only in the second compressor unit out of the first compressor unit and the second compressor unit.

9. The refrigeration apparatus of claim 8, wherein the controller performs, as the transfer operation, an operation of increasing a rotational speed of a compressor of the first compressor unit and decreasing a rotational speed of a compressor of the second compressor unit.

10. The refrigeration apparatus of claim 1, wherein when the controller determines that the gas refrigerant is flowing through the oil return pipe in the detection operation in a case where a rotational speed of the compressor is a predetermined value or more, the controller performs a recovery operation of returning refrigerating machine oil staying outside the compressor unit to the compressor unit.

11. The refrigeration apparatus of claim 1, wherein the controller performs a recovery operation of returning refrigerating machine oil staying outside the compressor unit to the compressor unit when a predetermined recovery condition is satisfied, and does not perform the recovery operation even if the recovery condition is satisfied when it is not determined in the detection operation that the gas refrigerant is flowing through the oil return pipe when a rotational speed of the compressor is a predetermined value or less.

* * * * *